United States Patent [19]

Cushing

[11] 4,249,090

[45] Feb. 3, 1981

[54] AUTOMATIC RESETTING POWER SAVER SWITCH FOR DISHWASHER

[75] Inventor: Donald S. Cushing, Louisville, Ky.

[73] Assignee: General Electric Company, Louisville, Ky.

[21] Appl. No.: 31,793

[22] Filed: Apr. 20, 1979

[51] Int. Cl.[3] ..... B08B 3/10; B08B 13/00

[52] U.S. Cl. ..... 307/154; 200/61.62; 134/57 DL

[58] Field of Search ..... 307/119, 120, 98, 112, 307/139, 140, 154; 200/50 A, 61.62, 61.67, 61.72, 61.79, 61.8, 61.81; 134/57 DL, 58 DL, 105, 113

[56] References Cited

U.S. PATENT DOCUMENTS

| | | | |
|---|---|---|---|
| 3,007,479 | 11/1961 | Jacobs | 134/58 |
| 3,028,869 | 4/1962 | Jordan | 134/58 |
| 3,028,870 | 4/1962 | Fay | 200/61.8 |
| 3,635,229 | 1/1972 | Jacobs | 134/58 D |
| 3,742,162 | 6/1973 | Nasemann | 200/61.62 |
| 3,924,085 | 12/1975 | Stone | 200/61.62 |
| 4,134,003 | 1/1979 | Hahn | 219/327 |

*Primary Examiner*—Donald A. Griffin

*Assistant Examiner*—S. D. Schreyer

*Attorney, Agent, or Firm*—H. Neil Houser; Radford M. Reams

[57] ABSTRACT

A switch and latch arrangement for use in a washing appliance of the type providing for user selection of one of two dry cycle options in which option selection is coupled to the door latch mechanism in such a manner that movement of the door latch means from a latched to an unlatched position assures that a predetermined one of said options is automatically selected, requiring manual override at that selection by the user after latching the door if the other option is desired. In an illustrative embodiment, the switch and latch arrangement is used in a dishwasher which provides for user selection of a non-heated dry option or a heated dry option. An option selection button, movable between a first portion for enabling the non-heated option and a second position for enabling the heated dry option is provided. The selection button is mechanically coupled to movement of the door latch handle in such a manner that in response to movement of the latch handle from its latched position to its unlatched position the selection button will always assume its first position.

3 Claims, 6 Drawing Figures

AUTOMATIC RESETTING POWER SAVER SWITCH FOR DISHWASHER

BACKGROUND OF THE INVENTION

Domestic dishwashing appliances typically employ a drying cycle which uses heat to dry the dishes. One means of reducing the energy consumption of such appliances is to provide the user with a choice of two drying options, one being the conventional heated dry option and the second being an energy saving non-heated dry option. The user, by way of a pushbutton, rotary knob, or a slider provided on the control panel of the appliances, manually selects the desired option. A shortcoming of dishwashing appliances presently available which provide such options is that the choice, once made, remains in effect through subsequent uses of the machine until an opposite choice is made. Thus, should the user select the heated drying option for one load of dishes, this selection would remain in effect for all subsequent loads until the non-heated dry option is selected. In order to more fully exploit the energy savings potential of the non-heated dry option, it would be advantageous to automatically provide the non-heated dry option each time an operating cycle is initiated unless the user consciously selects the heated dry option. With such an arrangement, in instances where the user doesn't really need the heated dry option or doesn't care which option is selected, the non-heated dry option would automatically be selected for the next load regardless of the option selected for the previous load.

Thus, it is an object of the present invention to provide a switch arrangement in a washing appliance of the type providing heated dry and non-heated dry options for the dry cycle, which automatically provides the non-heated dry option for each new wash load requiring the user to consciously select the heated dry option for each cycle in which that function is desired regardless of the option selected for the previous load.

It is a further object of the present invention to provide a switch arrangement for a washing appliance of the above-described type wherein an option selection switch is automatically reset to the non-heated dry setting upon each cycle interruption caused by unlatching of the dishwasher door either during the operating cycle or at the end thereof.

It is a further object of the present invention to provide a switch arrangement for a washing appliance of the above-described type in which the option selection switch is mechanically linked to the door latch such that the movement of the latch from a latched position to an unlatched position automatically resets the switch to the non-heated dry setting.

SUMMARY OF THE INVENTION

The above and further objects are accomplished in accordance with a preferred embodiment of the present invention by an improved switching arrangement for a dishwashing appliance which provides manually operable means for user selection of one of two dry cycle options, a heated dry option or a non-heated dry option, operable for selecting between a first setting for enabling the non-heated dry option and a second setting for enabling the heated dry option, the improvement comprising means for coupling the manually operable selecting means with the appliance door latching means such that the unlatching of the door latch automatically places the selection means in its first setting regardless of its setting prior to unlatching. This arrangement requires the operator to manually select the heated dry option or second setting each time the door is unlatched when that option is desired.

In an illustrative embodiment of the invention, the coupling means comprises a slider arm provided in the interior of the appliance door slidably mounted to the door panel. The arm includes a first tab which extends outwardly through a slot in the door to provide manually operable means for user manipulation of the slider arm. A second tab is provided spaced apart from the first tab which projects inwardly toward the interior of the door. Also extending inwardly from the arm is an actuator. The arm is movable between a first, non-heated dry position and a second, heated dry position. Also provided in the interior of the door mounted to a door panel opposite the slider arm is a two-position, snap-action switch which is electrically connected in series with a heating element disposed in the interior of the appliance cabinet. When the slider arm is in its first position, the actuator is remote from the switch and the contacts are open. When the bar is in its second position, the actuator engages the switch closing the contacts, thereby enabling energization of the heating element for the heated dry option.

A door latch mechanism including a latch handle is provided for securing the door in the closed position. The latch handle includes an extension for engaging the slider arm. When the slider arm is in its second position, the second tab extends into the travel path of the latch handle extension. As the latch handle is moved from a latched position in which the door is securely closed to an unlatched position for opening the door, the extension engages the second tab, causing the slider arm to assume its first, non-heated dry position. The slider arm remains in this position unless manually moved to the second, heated dry position by mover manipulation of the first tab. When in the second position, any unlatching of the door latch will reset the slider arm to the non-heated dry position.

A full understanding of the invention may be had by a study of the drawings and detailed description which follow.

DETAILED DESCRIPTION OF AN ILLUSTRATIVE EMBODIMENT OF THE INVENTION

This invention is particularly useful in a dishwashing appliance which enables the user to manually select one of two dry cycle options, a heated dry option, so-called "power dry," in which the dishes are dried rapidly by supplying heat to the interior of the washing chamber and a so-called "power saver" option or non-heated dry option in which no heat is supplied during the dry cycle. A manually operable selection means is switchable by the user between a first setting which enables the non-heated dry option and a second setting which enables the heated dry option. The present invention provides means for linking this option selection with the unlatching of the door latch mechanism such that movement of the latch handle from its latched to its unlatched position automatically positions the selection means in its first setting, for selection of the non-heated dry option. Consequently, in order to implement the heated dry option, the user must manually select this option after closing the door and moving the latch handle to its latched position. This option, if desired, must be reselected in this way following each relatching of the door regardless of whether the latch is unlatched during or between operating cycles.

Figure 4:
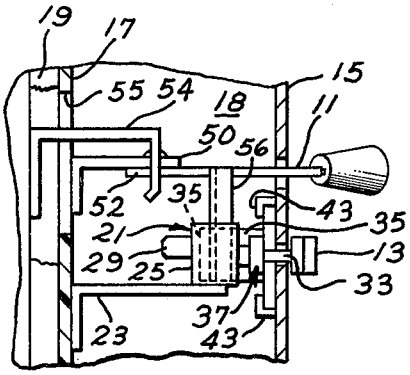
FIG. 4 is a side view taken along lines 4—4 of FIG. 2 with portions cut away to better show the illustrative embodiment of the invention.

In order to facilitate a more thorough understanding of this invention, an illustrative embodiment will be described in the dishwasher environment shown in FIGS. 1, 2 and 4.

Figure 1:
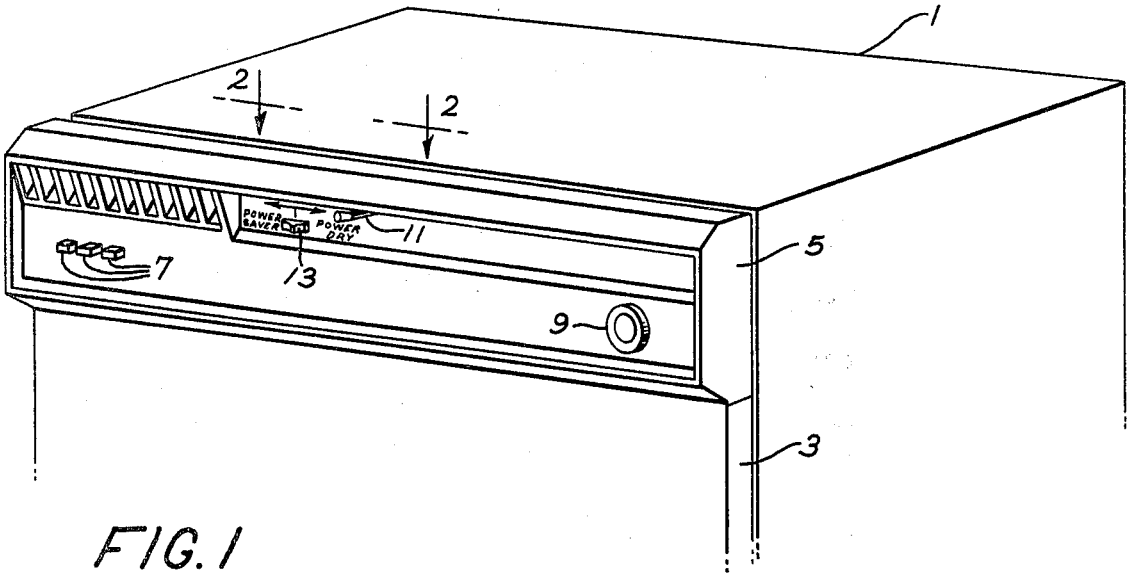
FIG. 1 is a perspective view of the upper portion of a dishwasher incorporating an illustrative embodiment of the invention.

FIG. 1 showns a portion of an automatic dishwasher which includes a cabinet 1 having a front access opening (not shown) for receiving dishes to be washed. This access opening is closed by a door 3 which is secured in its closed position by a latch mechanism manually operated by movement of latch handle 11.

An escutcheon 5 is mounted near the upper edge of door 1. Projecting externally from the escutcheon are control buttons 7, a timer control knob 9, the door latch handle 11, and option selecting means in the form of a slider knob 13. Movement of slider knob 13 to the right selects the heated dry or so-called power dry option; movement to the left selects the non-heated dry or so-called power saver option. As shown in FIG. 2, door 3 is of hollow double wall construction having an outer panel 15 and an inner panel 17 which define therebetween a hollow area 18. A rubber gasket 19 is positioned on inner panel 17 between cabinet 1 and inner panel 17 to provide sealing engagement therebetween. A switch means designated generally at 21 comprises a standard snap action mechanism incorporated within a housing 25, and further includes a pushbutton 27 projecting through an opening in housing 25, and contacts 29 projecting from housing 25 for electrical connection of the switch in the heating element circuit of FIG. 5. Switch housing 25 is mounted within area 18 to a bracket 23 by screws 28. Bracket 23 is fixed to panel 17. A heating element (shown schematically at 84 in FIG. 5) is physically positioned in the lower portion of the wash chamber in the interior of the appliance in the conventional manner well known in the art for supplying heat for heating the water during certain cycles and for drying during the heated dry cycle. The electrical circuitry will be described hereinafter with regard to FIG. 5. To avoid unnecessary complexity, the electrical connections to the contacts 29 are not shown in FIGS. 2 and 4. Since any number of commercially available snap-action mechanisms may be employed and since the details thereof are not part of the invention, details of the snap-action mechanism have not been shown.

Figure 3:
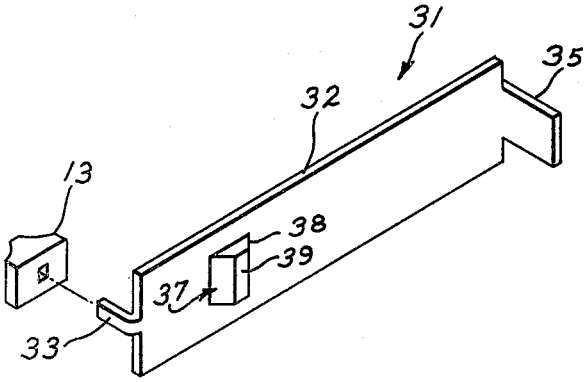
FIG. 3 is a separate perspective view of the slider bar employed in the illustrative embodiment of the invention.

Switch means 21 is actuated by an actuating member 37 projecting from a slider arm 31. The structure of slider arm 31 is better illustrated in FIG. 3. As shown in FIG. 3, slider arm 31 is an elongated member comprising a flat bar portion 32, a first tab 33 projecting inwardly as seen in FIG. 3 and a second tab 35 spaced apart from the first tab projecting outwardly. Actuating member or, more simply, actuator 37 projects from the bar portion in the same direction as tab 35. Actuator 37 comprises a generally ramp-like portion 38 sloping outwardly from the bar, ending in a flat portion 39. Ramp-like portion 38 is provided to enable the smooth engagement and depression of pushbutton 27 by actuator 37, as slider arm 31 slides in a direction transverse to the direction of motion of the pushbutton.

Figure 5:
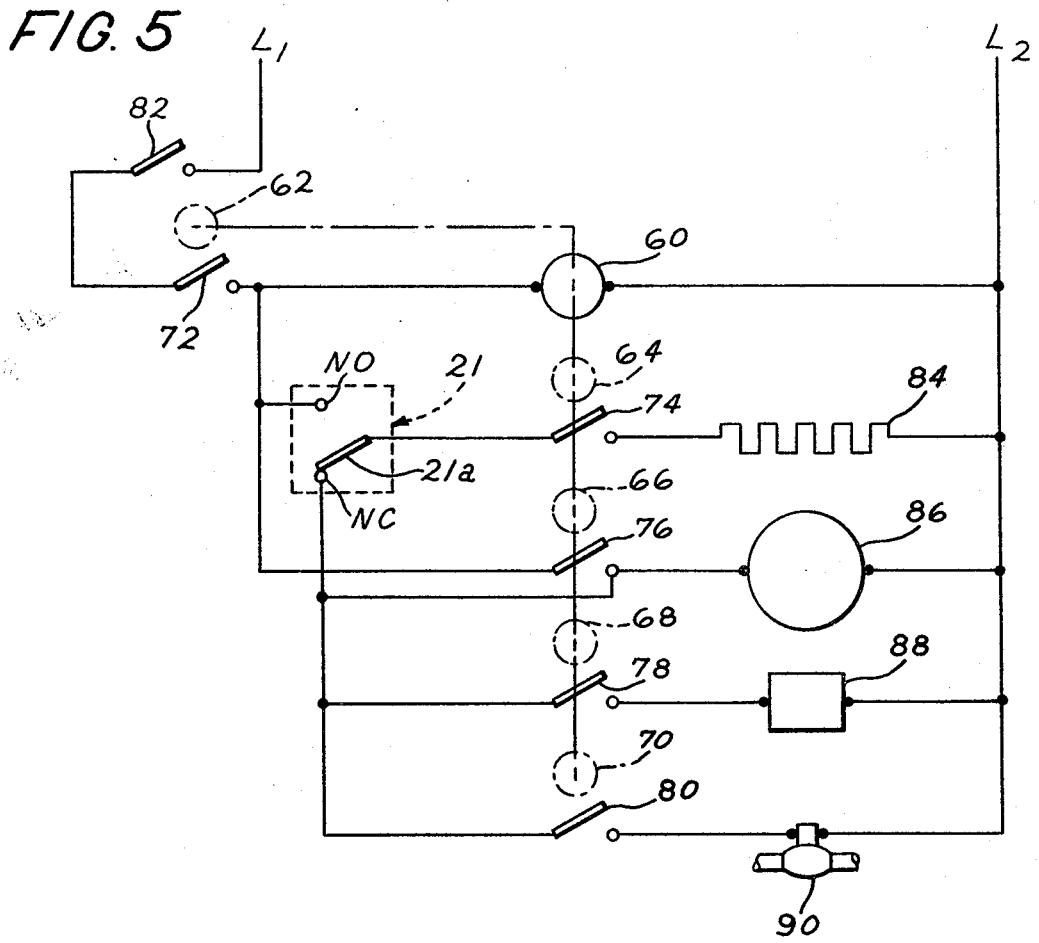
FIG. 5 is a schematic diagram of a control circuit employing the switch of the illustrative embodiments shown in FIGS. 1, 2 and 4.

Referring again to FIG. 2, slider arm 31 is shown slidably mounted to the interior of outer door panel 15, held in place by slider guides 43 projecting from door panel 15. Tab 33 projects without door 3 via slot 41 in panel 15 to provide manually operable selection means. Selector button 13 is fastened to the portion of tab 33 projecting externally from slot 41. Tab 35 projects inwardly toward the door interior 18 to provide resetting means. Similarly, actuator 37 projects inwardly toward the door interior 18. Slider arm 31 is manually movable by user manipulation of tab 33 between a first position shown in phantom (FIG. 2) in which tab 33 closely approaches one edge of slot 41, and a second position shown in full in which tab 33 closely approaches the opposite edge of slot 41. Placement of the slider arm in the first position enables the non-heated dry option by releasing pushbutton 27; placement in the second position enables the heated dry option by depressing pushbutton 27. To this end, as the slider arm approaches its second position, in moving from its first position, pushbutton 27 is initially engaged by the ramp portion 38 of actuator 37. Further movement of the bar toward its second position causes the ramp to continue to further depress pushbutton 27 until when fully positioned in its second position the pushbutton is in depressed engagement with flat portion 39 of actuator 37. In this position, the pushbutton 27 is sufficiently depressed to close the snap-action switch mechanism. As shown in FIG. 5, heating element 84 is serially connected with the normally open contacts of switch 21, thus closure of the switch closes the normally open contacts, thereby enabling energization of heating element 84 through switch 21. When pushbutton 27 is not depressed, the normally open contacts of switch 31 are open, thereby preventing energization of the heating element.

Latch handle 11 is pivotally mounted to mounting bracket 50 which is fixed to the inner door panel 17 and projects into the area 18. Latch handle 11 includes a latching portion 52 which engages latch keeper 54 when in the latched position (shown in full in FIG. 2). Latch keeper 54 is mounted to cabinet 1 and projects into area 18 through slot 55 when the door is in its closed position. Latch handle 11 also includes an extension 56 which extends downwardly from handle 11 as shown more clearly in FIG. 4. This extension serves to engage the resetting means comprising tab 35 for moving slider arm 31 from its second position (full lines) to its first position (phantom lines) as latch handle 11 is moved from its latched position (full lines) to its unlatched position (phantom lines).

Figure 2:
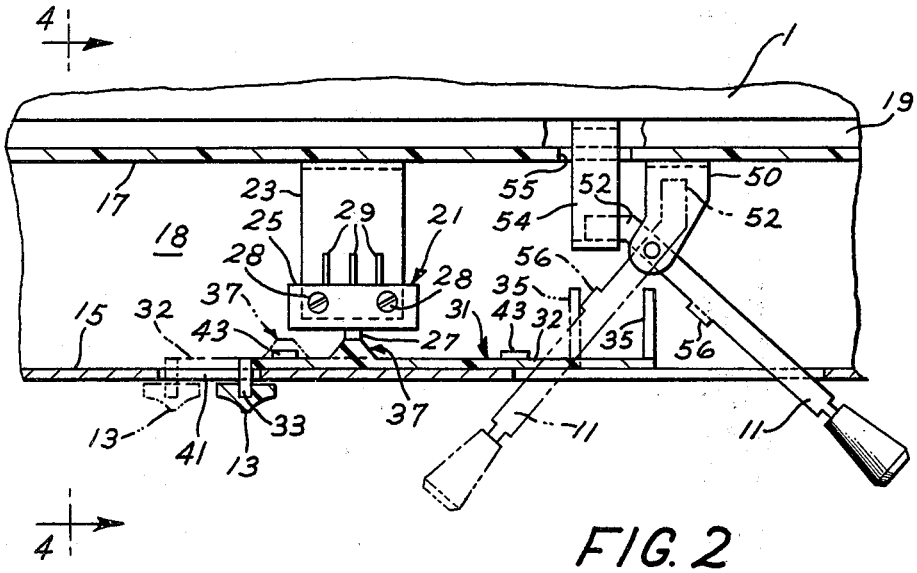
FIG. 2 is a plan view taken along lines 2—2 of FIG. 1 with portions cut away to better show an illustrative embodiment of the invention.

As shown in FIG. 2, when slider arm 31 is in its second position which corresponds to the selection of the power dry option, tab 35 extends into the arcuate path followed by latch handle extension 56 on moving between its latched position and its unlatched position. Thus, as latch handle 11 is moved in a clockwise direction, as seen in FIG. 2, from its latched to its unlatched position, latch handle extension 56 engages tab 35 at some point in its travel path between its latched and unlatched position and pushes slider arm 31 to its first position. Upon subsequent movement of the latching arm from its unlatched back to its latched position, extension 56 disengages tab 35 leaving slider arm 31 undisturbed in its first position and free to be manually moved by the user if selection of the power dry option is desired.

Switch 21 must be mounted in sufficiently close proximity to slider arm 31 to allow actuator 37 to depress pushbutton 27 thereby placing the snap-action switch mechanism in its closed state when slider arm 31 is in its second position. In this position, (shown in full in FIG. 2) actuator 37 is generally centered over pushbutton 27 and in pressing engagement therewith. When slider arm 31 is in its first position (shown in phantom) actuator 37 is remote from pushbutton 27 allowing pushbutton 27 which is biased outwardly to be fully extended. When fully extended the snap-action mechanism is placed in its open state.

An illustrative embodiment of an electrical circuit incorporating the switch means 31 is shown schematically in FIG. 5. This circuit includes a sequence control means or timer control comprising a timer motor 60 and a plurality of rotatable cams 62, 64, 66, 68 and 70. It will be apparent to one skilled in the art that the cams may be individual cams or separate cam surfaces on a single rotating member. Control knob 9 (FIG. 1) accessible at the front of escutcheon 5 for manipulation by a user is mechanically linked to cam 62 whereby the cycle of the machine can be initiated, adjusted, or interrupted. The knob 9, cams 62–70, and timer motor 60 are commonly housed and are mechanically interconnected in a well known manner.

Power is available to the control circuit of FIG. 5 through terminals L1 and L2 which are provided for connection to the household power supply. A door interlock switch 82 is operative with the closing of door 3 such that the circuit cannot be energized unless door 3 is securely closed. Manual advancement of knob 9 by the user rotates cam 62 to close switch 72. Switch 72 controls energization of the timer motor 60 which, when energized, drives cams 62–70. When energized, timer motor 60 drives all the cams in unison. Each of the cams is designed to actuate and close or open associated ones of switches 72–80, whereby various machine components are energized and deenergized at predetermined times in the cycle. In the circuit of FIG. 5, timer motor 60 is in series with switch 72, heating element 84 is in series with switch 74, pump motor 86 is in series with switch 76, drain solenoid 88 is in series with switch 78 and water valve solenoid 90 is in series with switch 80.

Figure 6:
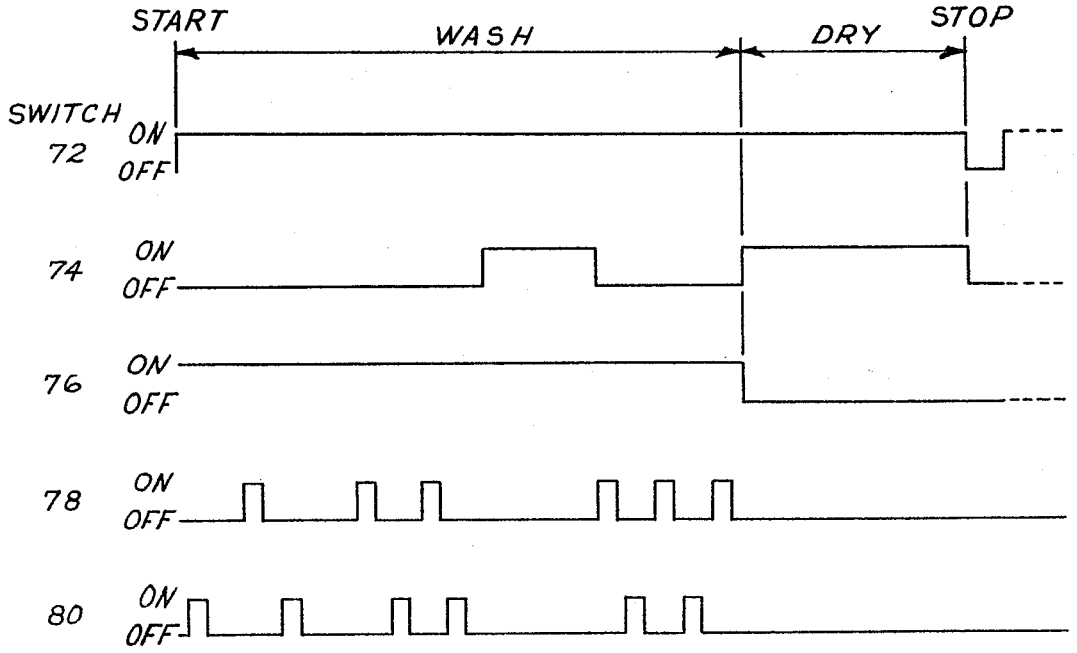
FIG. 6 is a typical timing diagram illustrating the state of the various switches as a function of time for a typical operating cycle for the dishwasher of the illustrative embodiment.

Conventionally, cams 62–70 are arranged such that a complete operational dishwashing cycle involves one or more sequences of pre-rinse, wash and rinse periods, the last rinse period being followed by a drying period. In the illustrative embodiment herein described, the drying period may be one of two options, a heated dry or so-called power dry, in which heating element 84 is energized or a non-heated dry or so-called power saver dry in which heating element 84 is not energized. However, the operation of the sequence control means is the same regardless of the option selected. At the time in the cycle when it is desired to energize heating element 84, switch 74 is closed by cam 64. As shown in FIG. 6, there are two cycles when switch 74 is closed, namely the wash cycle when heating element 84 is to be energized to heat the water while pump motor 84 is energized via switch 76 to circulate the water, and the dry cycle during which only the heating element is to be energized.

As mentioned hereinbefore, the operation of switch 74 is the same regardless of which dry option is selected. Switch 21 determines whether heating element is energized during the dry cycle. In FIG. 5, switch blade 21(*a*) is shown in the normally closed position. This is the position in which pushbutton 27 is not depressed corresponding to the first non-heated dry position for slider arm 31. With switch 21 in this normally closed state, heating element 84 is prevented from being energized during the dry cycle when only switch 74 is closed. However, during that portion of the wash cycle when both switches 74 and 76 are closed, heating element 84 is energized through switches 76 and 74 and the normally closed contacts of switch 21.

Selection of the heated dry option by placing slider arm 31 in its second position moves contact blade 21(*a*) to the normally open position (NO). In this position, heating element 84 is energized through the normally open contacts of switch 21 and switch 74 during the wash cycle and the dry cycle.

In operation, the user first closes the appliance door and latches it by moving latch handle 11 to its latched position, then selects the desired dry cycle option. If the non-heated dry option is desired, the user does not need to manipulate selection button 13. If the heated dry option is desired, the user must move selection button 13 to the power dry position, thereby closing the normally open contacts of switch 21. The selection button 13 and consequently switch 21 will remain in the power dry position until the latch is unlatched. Movement of latch handle 11 from its latched position to its unlatched position moves slider arm 31 and consequently selection button 13 to the power saver position, thereby closing the normally closed contacts of switch 21. Thus, following each opening of the latch, the power dry option must be manually selected if that option is desired.

While a specific embodiment of the invention has been illustrated and described herein, it is realized that numerous modifications and changes will occur to those skilled in the art. For example, by reversing the normally open and normally closed contacts of switch 21 in the circuit of FIG. 5, the heated dry option can be automatically provided, requiring the user to manually select the non-heated dry option when that option is desired. Linking of the option selection means with the latch means may be accomplished by electrically coupling these means rather than the mechanical linkage of the illustrative embodiment. Also, mechanical linkages which are structurally different but functionally the same may be employed. It is therefore understood that the appended claims are intended to cover all such modifications and changes as fall within the true spirit and scope of the invention.

What is claimed is:

1. A switch and latch arrangement for a washing appliance of the type incorporating a heating element and providing the operator a choice of two dry cycle options, a non-heated dry option and a heated dry option, said switch and latch arrangement comprising:

switch means adapted for serial connection with the heating element, said switch means having a first state and a second state; said switch means being operative in its first state to enable the non-heated dry option by preventing energization of the heating element during the drying cycle and operative in its second state to enable the heated dry option by enabling energization of the heating element during the drying cycle;

selection means manually switchable between a first operative state and a second operative state; said selection means being operative in its first operative state to place said switch means in its first state and in its second operative state to place said switch means in its second state;

door latch means movable between a latched position and an unlatched position; and resetting means responsive to said latch means for assuring that said selection means assumes its first operative state when said latch means is moved from its latched to its unlatched position, thereby requiring the operator to manually place said selection means in its second operative state after said latch means is returned to its latched position when the heated dry option is desired.

2. A switch and latch arrangement for a washing appliance of the type incorporating heater means and which allows the user to select one of two drying cycle options, a first option and a second option, said arrangement comprising:

an appliance door comprising two walls and a hollow portion formed therebetween;

an elongated member slidably mounted within said hollow portion and manually movable between a first position and a second position, said elongated member including: a first tab projecting without said door for user manipulation; an actuating member projecting within said hollow portion; and a second tab spaced apart from said first tab and projecting within said hollow portion;

switch means adapted for serial connection with the heater means, said switch means having a first state which prevents energization of the heater means during drying and a second state which enables energization of the heater means during drying;

said switch means being so disposed within said hollow portion relative to said elongated member that when said elongated member is in its first position, said actuating member places said switch means in its first state, and when said elongated member is in its second position, said actuating member places said switch means in its second state;

door latch means including a handle, said handle being movable between a latch position and an unlatched position;

said handle including an extension projecting therefrom;

said elongated member being so disposed relative to said latch means that when said elongated member is in its second position, said second tab projects into the travel path of said handle extension so that as said latch handle moves from its latched to its unlatched position said handle extension engages said second tab and thereby moves said elongated member to its first position.

3. A door latch and control arrangement for a washing appliance of the type which provides first and second dry cycle options, the first option being heated dry in which a heating element is energized during the dry cycle and the second being non-heated dry in which the heating element is not energized during the dry cycle, said arrangement comprising:

an appliance door including a hollow portion therein;

latch means mounted on said door;

said latch means including a latch handle movable between an unlatched position and a latched position;

switch means mounted within said hollow portion and switchable between an open state and a closed state;

said switch means being adapted for electrical serial connection to the heating element;

said switch means enabling the heated dry option when in its closed state and enabling the non-heated dry option when in its open state;

switch actuating means mounted to said door and slidable between a first position in which said actuating means places said switch means in an open state and a second position in which said actuating means places said switch means in its closed state;

said switching actuating means including an elongated member slidably mounted within said door having a manually operable tab projecting outwardly through said door for sliding said switch actuating means between its first and second positions and said elongated member further including an inwardly projecting mechanically operable tab disposed for engagement by said latch handle when said switch actuating means is in its second position and said latch handle is in its latched position, such that movement of said latch handle from its latched to its unlatched position moves said actuating means from its second to its first position;

whereby said switch means may be manually opened or closed and said switch means will be open following each movement of said latch handle to its open position and remain open unless subsequently manually moved to its first position.

* * * * *